US009190781B2

(12) United States Patent
Chang

(10) Patent No.: US 9,190,781 B2
(45) Date of Patent: Nov. 17, 2015

(54) STACKING CONNECTOR HAVING DETECTION FUNCTION

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 26 days.

(21) Appl. No.: 14/167,993

(22) Filed: Jan. 29, 2014

(65) Prior Publication Data

US 2014/0220796 A1 Aug. 7, 2014

(30) Foreign Application Priority Data

Feb. 7, 2013 (TW) ..... 102202857 U

(51) Int. Cl.

| | |
|---|---|
| ***H01R 13/60*** | (2006.01) |
| ***H01R 13/66*** | (2006.01) |
| ***H01R 29/00*** | (2006.01) |
| *H01R 13/658* | (2011.01) |

(52) U.S. Cl.

CPC ..... *H01R 13/6683* (2013.01); *H01R 29/00* (2013.01); *H01R 13/658* (2013.01); *H01R 2201/06* (2013.01)

(58) Field of Classification Search

CPC ..... H01R 23/7073; H01R 23/6873; H01R 23/025; H01R 13/514; H01R 27/02; H01R 13/641; H01R 13/6272; H01R 13/639; H01R 13/7032; H01R 13/65802; H01R 13/658; H04Q 1/149

USPC ..... 439/541.5, 489, 188, 607.4, 607.35

See application file for complete search history.

(56) References Cited

U.S. PATENT DOCUMENTS

| | | | | |
|---|---|---|---|---|
| 5,470,251 | A * | 11/1995 | Sano | 439/489 |
| 5,775,936 | A * | 7/1998 | Tsuji | 439/489 |
| 6,162,089 | A * | 12/2000 | Costello et al. | 439/541.5 |
| 6,210,232 | B1 * | 4/2001 | Lai et al. | 439/620.08 |
| 6,273,757 | B1 * | 8/2001 | David et al. | 439/607.13 |
| 6,350,152 | B1 * | 2/2002 | Belopolsky et al. | 439/541.5 |
| 6,364,707 | B1 * | 4/2002 | Wang | 439/607.53 |
| 6,520,799 | B1 * | 2/2003 | Cheng et al. | 439/541.5 |
| 6,533,612 | B1 * | 3/2003 | Lee et al. | 439/564 |
| 6,540,563 | B1 * | 4/2003 | Hu et al. | 439/676 |
| 6,663,423 | B2 * | 12/2003 | Belopolsky et al. | 439/541.5 |
| 6,939,168 | B2 * | 9/2005 | Oleynick et al. | 439/541.5 |
| 7,008,762 | B2 * | 3/2006 | Zhang et al. | 439/541.5 |
| 7,083,468 | B2 * | 8/2006 | Walker et al. | 439/541.5 |
| 7,207,819 | B2 * | 4/2007 | Chen | 439/188 |
| 7,364,463 | B1 * | 4/2008 | Ju | 439/607.55 |
| 7,798,832 | B2 * | 9/2010 | Qin et al. | 439/188 |
| 7,942,702 | B2 * | 5/2011 | Chang | 439/638 |
| 8,007,320 | B1 * | 8/2011 | Zhang et al. | 439/638 |

(Continued)

*Primary Examiner* — Abdullah Riyami
*Assistant Examiner* — Vladimir Imas
(74) *Attorney, Agent, or Firm* — Chun-Ming Shih; HDLS IPR Services

(57) ABSTRACT

A stacking connector comprises a main body and a plurality of connectors. The main body has a first containing slot and a second containing slot, the first containing slot arranges a connection module, and the second containing slot arranges a USB connector which has a detection function. The USB connector includes a body and a plurality of conductive terminals. The body has a tongue portion extended frontward from top side of the body. The tongue portion has a plurality of upper terminal slots, and each of the conductive terminals is set in a corresponding upper terminal slot. The body has at least one lower terminal slot at bottom side, and at least one detection terminal is set therein. When a male connector which can support high power transmission is inserted into the USB connector, the detection terminal is triggered, and the USB connector provides higher outputted power.

9 Claims, 18 Drawing Sheets

(56) References Cited

U.S. PATENT DOCUMENTS

| | | | | |
|---|---|---|---|---|
| 8,070,519 | B2 * | 12/2011 | Lin et al. | 439/620.24 |
| 8,100,720 | B2 * | 1/2012 | Lin et al. | 439/607.34 |
| 8,109,795 | B2 * | 2/2012 | Lin et al. | 439/660 |
| 8,137,137 | B1 * | 3/2012 | Chang | 439/607.07 |
| 8,162,691 | B2 * | 4/2012 | Chang | 439/541.5 |
| 8,182,283 | B2 * | 5/2012 | Chang | 439/541.5 |
| 8,206,174 | B2 * | 6/2012 | Ko | 439/489 |
| 8,460,030 | B2 * | 6/2013 | Chang | 439/541.5 |
| 8,485,843 | B2 * | 7/2013 | Chang | 439/541.5 |
| 8,529,290 | B2 * | 9/2013 | Chang | 439/541.5 |
| 8,545,274 | B2 * | 10/2013 | Purkis et al. | 439/668 |
| 8,678,857 | B2 * | 3/2014 | Zhang et al. | 439/541.5 |
| 8,721,364 | B2 * | 5/2014 | Lai et al. | 439/541.5 |
| 8,746,990 | B2 * | 6/2014 | Chang | 385/92 |
| 8,790,138 | B2 * | 7/2014 | Wang et al. | 439/660 |
| 9,004,949 | B2 * | 4/2015 | Chang | 439/620.22 |
| 2007/0059959 | A1 * | 3/2007 | Chen | 439/188 |
| 2010/0272404 | A1 * | 10/2010 | He et al. | 385/94 |
| 2011/0111625 | A1 * | 5/2011 | Chang | 439/578 |
| 2013/0051736 | A1 * | 2/2013 | Chang | 385/92 |
| 2013/0051737 | A1 * | 2/2013 | Chang | 385/92 |
| 2013/0210271 | A1 * | 8/2013 | Chang | 439/535 |

* cited by examiner

STACKING CONNECTOR HAVING DETECTION FUNCTION

BACKGROUND OF THE INVENTION

1. Field of the Invention

The present invention relates to a connector, and in particular to a stacking connector.

2. Description of Prior Art

These years, universal serial bus (USB) connector is very popular, almost every electronic device in the market is arranged at least one USB connector. The USB connector has the function of plug and play. Furthermore, because of the special pin define of the USB connector (Vcc, D−, D+, GND), an electronic device arranged the USB connector can use the USB connector to transmit power directly, it is very convenient.

The standard USB connector now in the market can provide 5V/500 mA output (which is power 2.5 W), it is enough to satisfy most electronic devices, such as mobile phone, human machine interface (HMI), 2.5-inch hard disk drive (HDD) to charge or to work. Accordingly, users can charge these electronic devices through a computer and a USB type cable, and users do not need to bring an additional charger.

Actually, the standard USB connector can provide outputted power higher than 2.5 W. However, the USB connector has the function of plug and play mentioned above, and user is used to pull out a USB device from the USB connector during usage, if the USB connector provides outputted power higher than 2.5 W without any detection means, it may cause the USB device, the USB connector or the electronic device arranged the USB connector to be burned while the USB connector is pulled out.

SUMMARY OF THE INVENTION

The present invention is to provide a stacking connector, wherein the stacking connector is arranged at least one USB connector which has a detection function. When being inserted by a male connector, the USB connector of the stacking connector can determine if the male connector can support high outputted power or not through the detection function. Therefore, the USB connector of the stacking connector can decide to provide and output standard power or specific power which is higher than the standard power.

A stacking connector mentioned above comprises a main body and a plurality of connectors. The main body has a first containing slot and a second containing slot thereon, the first containing slot arranges a connection module, and the second containing slot arranges a USB connector which has a detection function. The USB connector includes a body and a plurality of conductive terminals. The body has a tongue portion extended frontward from top side of the body. The tongue portion has a plurality of upper terminal slots, and each of the conductive terminals is set in a corresponding upper terminal slot. The body has at least one lower terminal slot at bottom side, and at least one detection terminal is set therein. When a male connector which can support high power transmission is inserted into the USB connector, the detection terminal is triggered, and the USB connector provides higher outputted power.

In comparing with related art, the present invention arranges a USB connector having a detection function on a stacking connector, so it can determine whether a male connector inserted in the USB connector can support high power transmission or not via the detection function of the USB connector. If the detection function doesn't being triggered, it means that the male connector can't support high power transmission, so the USB connector of the stacking connector only provides standard 5V/500 mA outputted power. Else if the detection function is triggered while the male connector is inserted into the USB connector, it means that the male connector can support high power transmission, so the USB connector provides higher outputted power.

As mentioned above, the USB connector can provide higher outputted power to the male connector, so an electronic device connected with the male connector can complete charging action more quickly. Furthermore, the USB connector in the present invention determines if the male connector connected to the USB connector can support high power transmission or not before outputting power, not provides high outputted power directly to all connected male connector. Therefore, it can prevent the male connector and the electronic device connected with the male connector from burning down because of receiving the outputted power higher than the standard power.

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
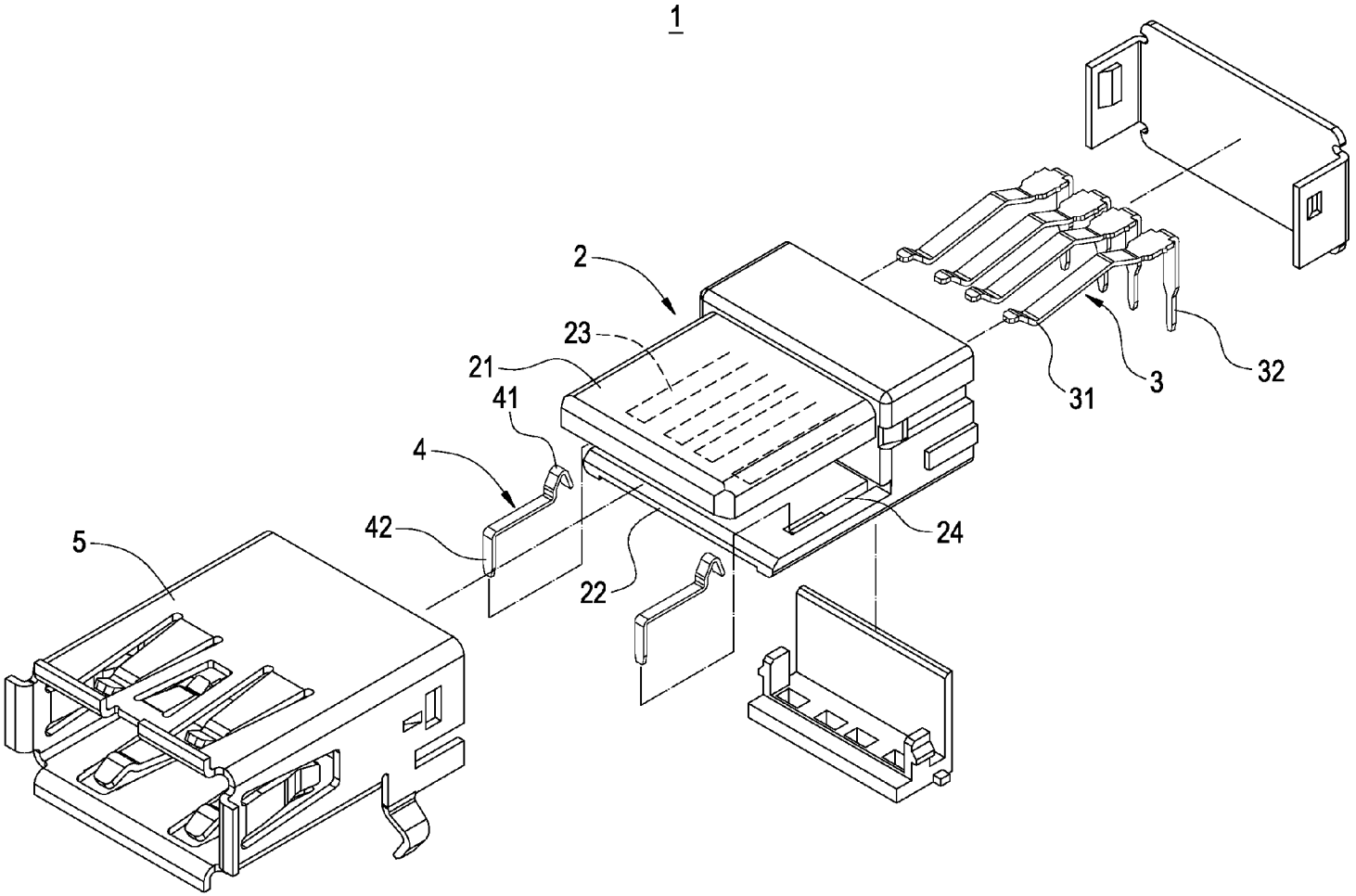
FIG. 1 is an exploded perspective view of a USB connector of a first embodiment according to the present invention.
Figure 2:
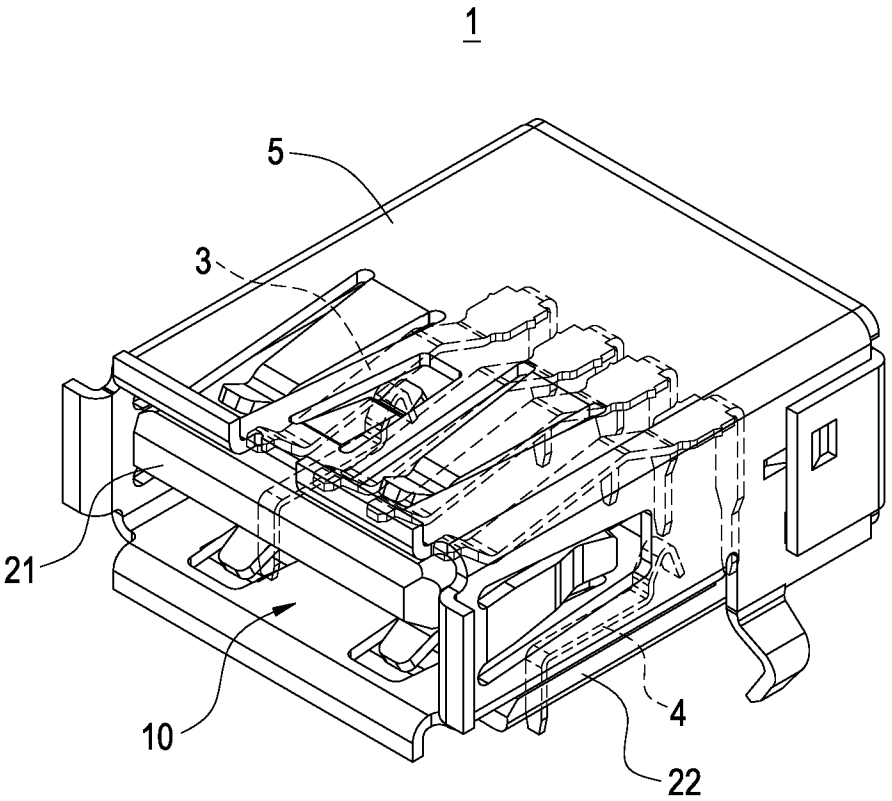
FIG. 2 is a combination perspective view of the USB connector of the first embodiment according to the present invention.
Figure 3:
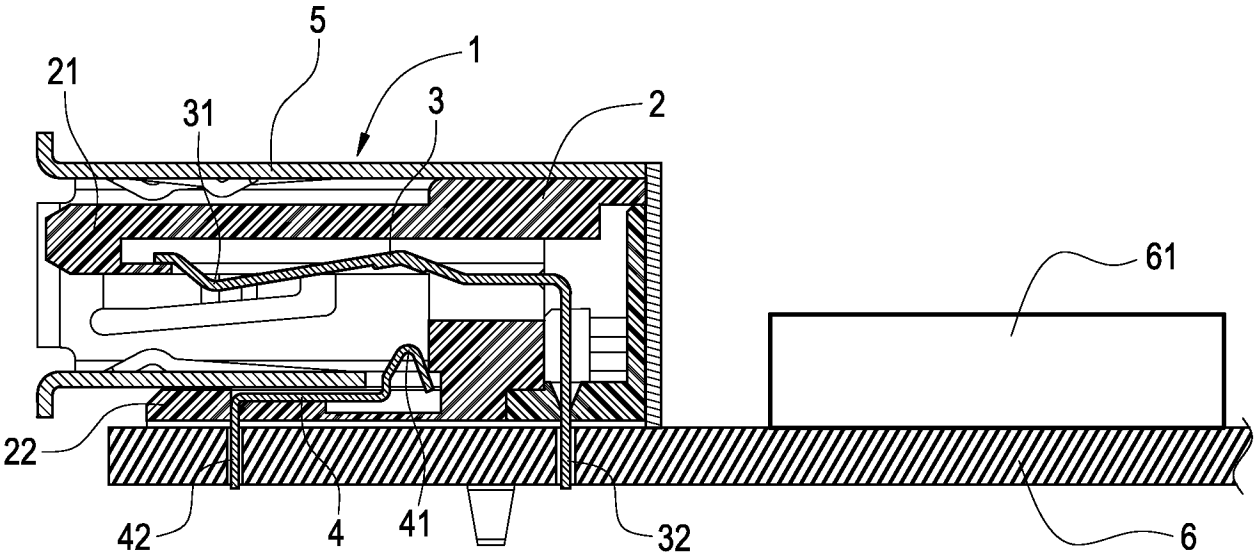
FIG. 3 is a section view of the first embodiment according to the present invention.

FIG. 1 is an exploded perspective view of a first embodiment according to the present invention. FIG. 2 is a combination perspective view of the first embodiment according to the present invention. FIG. 3 is a section view of the first embodiment according to the present invention. The present invention discloses a stacking connector (as shown in FIG. 8). The stacking connector comprises at least two connectors thereon, and at least one of the two connectors is a USB connector 1. The USB connector 1 in the present invention has a detection function, and the detection function can detect if a male connector inserted into the USB connector 1 can support high outputted power or not. In particularly, the high outputted power here indicates the outputted power which is higher than standard 5V/500 mA USB outputted power.

The USB connector 1 comprises a body 2, a plurality of conductive terminals 3, at least one detection terminal 4 and a metal housing 5. The body 2 has a tongue portion 21 extended frontward from a top side of the body 2, the tongue portion 21 has a plurality of upper terminal slots 23 thereon. The body 2 has a protruding portion 22 extended frontward from a bottom side of the body 2. The length of the protruding portion 22 is shorter than that of the tongue portion 21, and the protruding portion 22 has at least one lower terminal slot 24 thereon.

Each of the plurality of conductive terminals 3 is arranged in a corresponding upper terminal slot 23. Each of the plurality of conductive terminals 3 has a conductive portion 31 at one end and a welding portion 32 at the other end. Each of the conductive portions 31 is exposed out of the tongue portion 21, so the conductive terminals 3 can connect with terminals in an inserted male connector through the conductive portions 31. Each of the welding portions 32 is bended downward and extended out of the bottom side of the body 2, so the conductive terminals 3 can electrically connect to a circuit board 6 (as shown in FIG. 3) of an electronic device through the welding portions 32.

The detection terminal 4 has an abutting portion 41 at one end and a welding portion 42 away from the abutting portion 41 at the other end. The detection terminal 4 is arranged on the lower terminal slot 24 of the protruding portion 22, and the abutting portion 41 is exposed out of the protruding portion 22. As shown in FIG. 3, with a look straight into the USB connector 1 from a connection portion 10 at front face of the USB connector 1, the abutting portion 41 of the detection terminal 4 is arranged behind the conductive portions 31 of the plurality of conductive terminals 3. The welding portion 42 of the detection terminal 4 is bended downward and extended out of the bottom side of the body 2. The detection terminals 4 is electrically connected to the circuit board 6 through the welding portion 42, and electrically connected to a power controlling integrated circuit (IC) 61 arranged on the circuit board 6.

As shown in FIG. 1, an amount of the at least one detection terminal 4 is depicted as two in this embodiment, and the two detection terminals 4 are arranged at both sides of a rear edge of the protruding portion 22 separately. When being inserted by a male connector, the USB connector 1 can detect whether the insertion of the male connector is slanting or not via determining if the two detection terminals 4 are triggered at the same time. For simplicity description below, however, the USB connector 1 will be described with only one lower terminal slot 24 and only one detection terminal 4 in the specification, but not intended to limit the scope of the present invention.

In the present invention, the USB connector 1 is electrically connected to the power controlling IC 61 through the welding portion 42 of the detection terminal 4. If an external male connector can trigger the abutting portion 41 of the detection terminal 4 while inserting into the USB connector 1, it means that the male connector, a cable having the male connector, and an electronic device connected to the male connector through the cable are determined to have the ability of supporting high outputted power. Therefore, the power controlling IC 61 can control the USB connector 1 to output a specific power which is higher than standard 5V/500 mA outputted power, and the electronic device connected to the male connector can complete a charging action very quickly. For instance, the power controlling IC 61 can control the USB connector 1 to output the specific power in 5V/2.0 A, 12V/1.5 A, 12V/3.0 A, 12V/5.0A, 20V/3.0 A, or 20V/5.0 A. It is to say, the highest outputted power provided by the USB connector 1 can reach 100 W (20V×5.0 A=100 W).

If the inserted male connector can't trigger the abutting portion 41 of the detection terminal 4 while inserting into the USB connector 1, it means that the male connector, the cable having the male connector, and the electronic device connected to the male connector through the cable are determined to have not the ability of supporting high outputted power. Therefore, the power controlling IC 61 only controls the USB connector 1 to output the standard 5V/500 mA power, for preventing the male connector, the cable and the electronic device from burning down due to receiving power being higher than standard outputted power.

The metal housing 5 of the USB connector 1 encapsulates the body 2, the plurality of conductive terminals 3 and the detection terminal 4, for providing shielding effect. When being inserted into the USB connector 1, the above mentioned male connector abuts the metal housing 5 of the USB connector 1 directly through a shielding housing thereon. If the male connector can touch the abutting portion 41 of the detection terminal 4 through the shielding housing, the detection terminal 4 can conduct with the metal housing 5 through the shielding housing, and further conduct to the ground through the metal housing 5. In the present invention, the power controlling IC 61 determines the detection terminal 4 is triggered when the detection terminal 4 conducts to the ground through the metal housing 5.

Figure 4A:
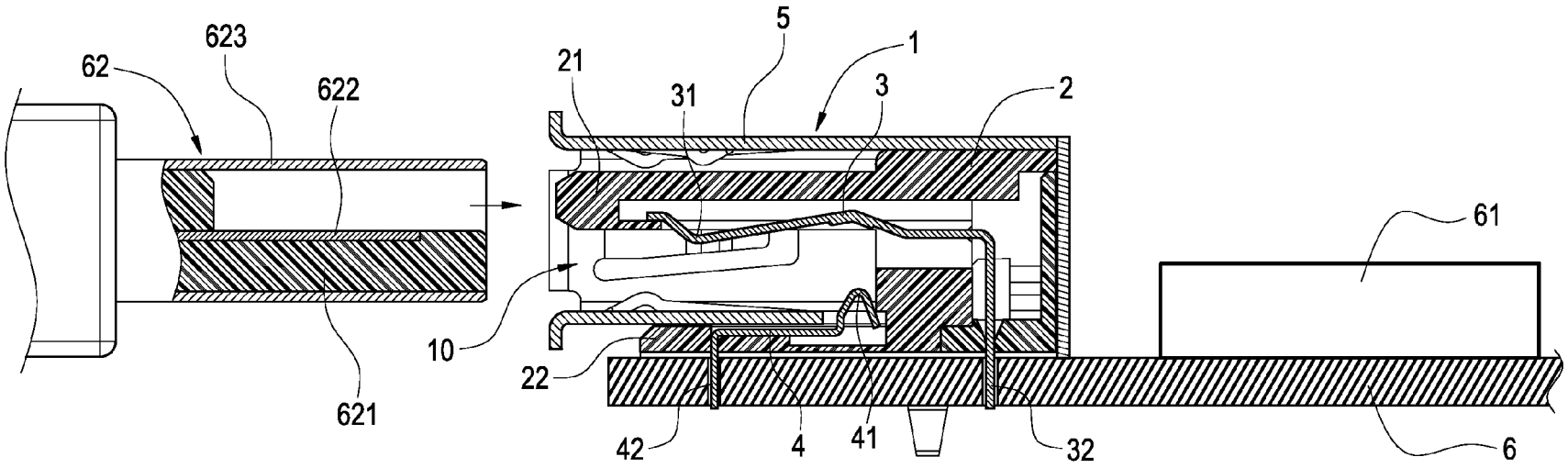
FIG. 4A is a perspective view showing the first embodiment according to the present invention before the insertion thereof.
Figure 4B:
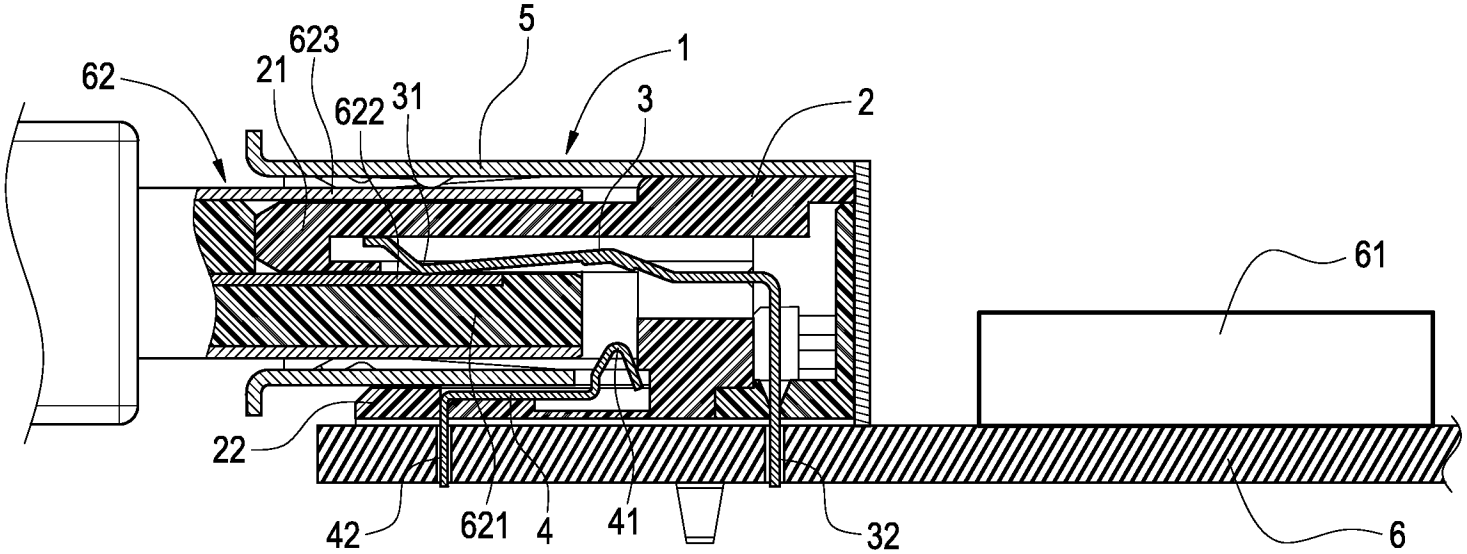
FIG. 4B is a perspective view showing the first embodiment according to the present invention after the insertion thereof.

FIG. 4A is a perspective view showing the first embodiment according to the present invention before the insertion thereof. FIG. 4B is a perspective view showing the second embodiment according to the present invention after the insertion thereof. The USB connector 1 in the present invention has the detection function, and the depth of the USB connector 1 is deeper than the depth of a standard USB connector. The normal depth of the standard USB connector is about 8.38+/−0.08 mm (almost equals to the length of the tongue therein). In the present invention, the USB connector 1 has the detection terminal 4 at a rear edge of the protruding portion 22, and the distance between the abutting portion 41 of the detection terminal 4 and a leading edge of the tongue portion 21 is more than 8.7 mm. In other embodiment, the distance between the abutting portion 41 of the detection terminal 4 and the leading edge of the tongue portion 21 is between 8.8 mm and 10.2 mm. In another embodiment, the distance between the abutting portion 41 of the detection terminal 4 and the leading edge of the tongue portion 21 is more preferably between 8.9 mm and 10.15 mm. And in the most preferable case, the distance between the abutting portion 41 of the detection terminal 4 and the leading edge of the tongue portion 21 is 9.58 mm, but not intended to limit the scope of the present invention. It should be mentioned that the distance between the abutting portion 41 of the detection terminal 4 and each of the conductive portions 31 of the plurality of conductive terminals 3 in the present invention, is between 4.4 mm and 5.08 mm for example, but not intended to limit the scope of the present invention.

As shown in FIG. 4A, the USB connector 1 is provided for an external male connector 62 to insert with. In this embodiment, the male connector 62 is a standard USB2.0 type male connector, and comprises a tongue board 621, a plurality of connection terminals 622 set in the tongue board 621 and exposed from the tongue board 621, and a shielding housing 623 encapsulating the tongue board 621 and the plurality of connection terminals 622. The male connector 62 can't support high power transmission, and as depicted in FIG. 4A, a leading edge of the shielding housing 623 and a leading edge of the tongue board 621 are aligned.

As shown in FIG. 4B, when the male connector 62 is inserted into the USB connector 1, each of the plurality of connection terminals 622 of the male connector 62 can electrically connect with a corresponding conductive terminal 3 of the USB connector 1, so as to transmit data and power to each other. As described above, however, the depth of the USB connector 1 is deeper than that of the standard USB connector (such as the male connector 62), and the detection terminal 4 is arranged at the rear edge of the protruding portion 22 of the USB connector 1. The length of the shielding housing 623 of the male connector 62 is not long enough for filling the depth of the USB connector 1, so the detection terminal 4 wouldn't be triggered when the USB connector 1 is inserted by the male connector 62. If the detection terminal 4 is not triggered, the power controlling IC 61 wouldn't trigger the USB connector 1, so the USB connector 1 can only provide and output the standard 5V/500 mA power to the male connector 62.

Figure 5A:
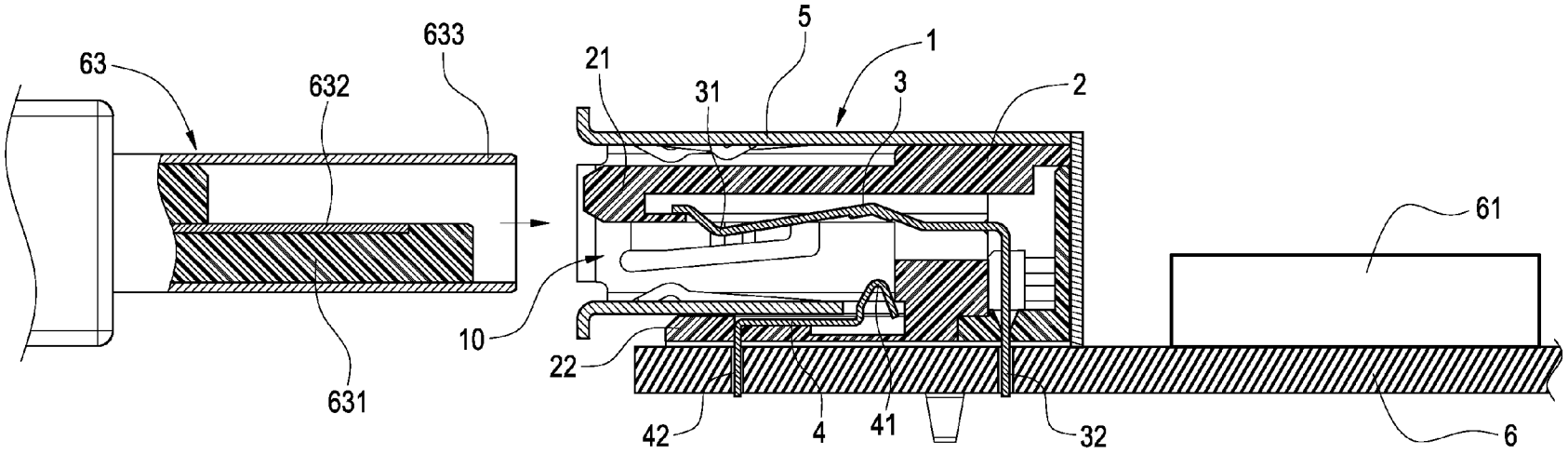
FIG. 5A is a perspective view showing a second embodiment according to the present invention before the insertion thereof.
Figure 5B:
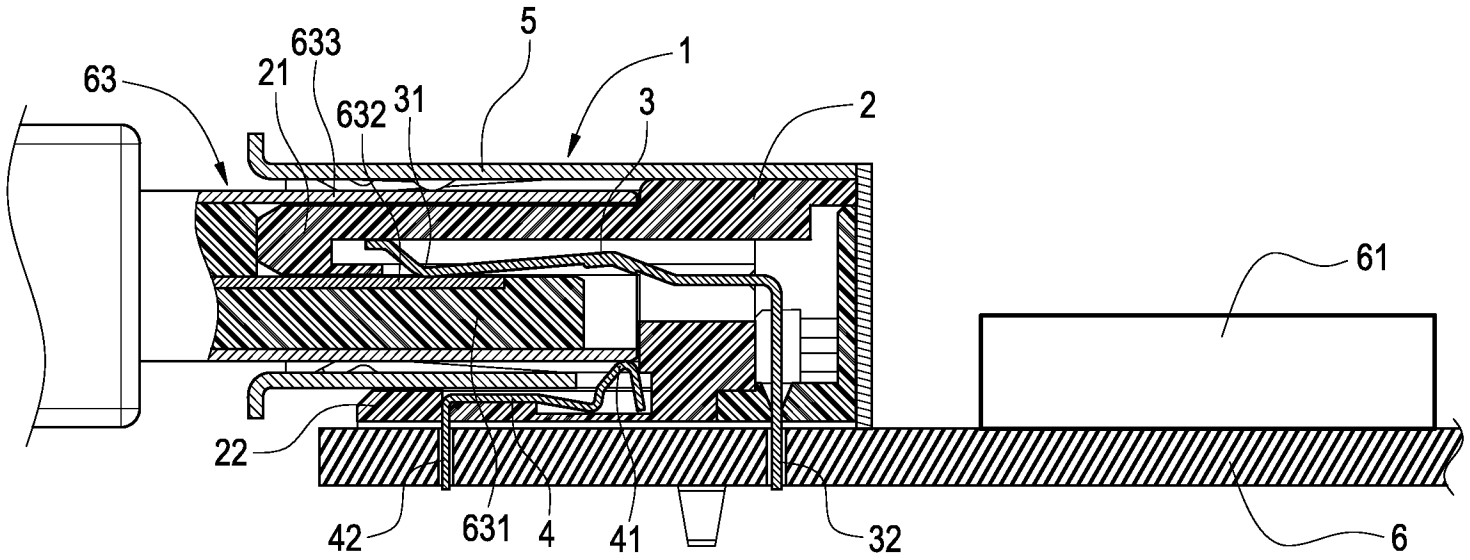
FIG. 5B is a perspective view showing the second embodiment according to the present invention after the insertion thereon.

FIG. 5A is a perspective view showing a second embodiment according to the present invention before the insertion thereof. FIG. 5B is a perspective view showing the second embodiment according to the present invention after the insertion thereof. An improved male connector 63 is disclosed in FIG. 5A and FIG. 5B. In the present invention, the improved male connector 63 (referred to as the male connector 63 hereinafter) is a kind of male connector which can support high power transmission. The male connector 63 comprises a tongue board 631, a plurality of connection terminals 632 set in the tongue board 631 and exposed from the tongue board 631, and a shielding housing 633 encapsulating the tongue board 631 and the plurality of connection terminals 632.

As shown in FIG. 5A, the length of the tongue board 631 in the male connector 63 is as long as the length of the tongue board 621 in the above mentioned male connector 62, however, the length of the shielding housing 633 of the male connector 63 is longer than that of the shielding housing 623 of the male connector 62. Accordingly, a leading edge of the shielding housing 633 and a leading edge of the tongue board 631 are not aligned as the male connector 62. As shown in FIG. 5B, the shielding housing 633 abuts the abutting portion 41 of the detection terminal 4 in the USB connector 1 directly while the male connector 63 is inserted into the USB connector 1, so as to trigger the detection terminal 4.

In particularly, in this case, the detection terminal 4 can touch the shielding housing 633 directly through the abutting portion 41, and the shielding housing 633 touches the metal housing 5 of the USB connector 1, so the detection terminal 4 can conduct to the ground through the metal housing 5. As the result, the power controlling IC 61 can conduct the ground through the detection terminal 4, the shielding housing 633 and the metal housing 5, so as to determine that the male connector 63 can support high outputted power via the conduction while the male connector 63 is inserted into the USB connector 1. Therefore, the power controller IC 61 can trigger the USB connector 1 to provide and output the specific outputted power higher than the standard 5V/500 mA outputted power.

Figure 6A:
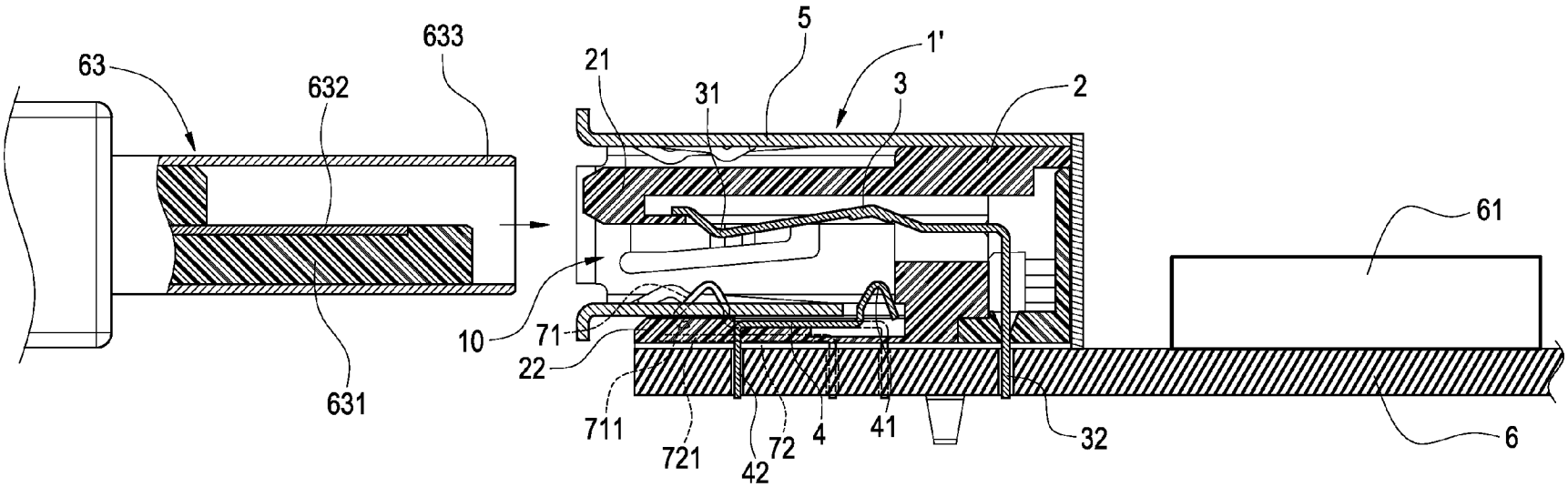
FIG. 6A is a perspective view showing a first insertion action of a third embodiment according to the present invention.
Figure 6B:
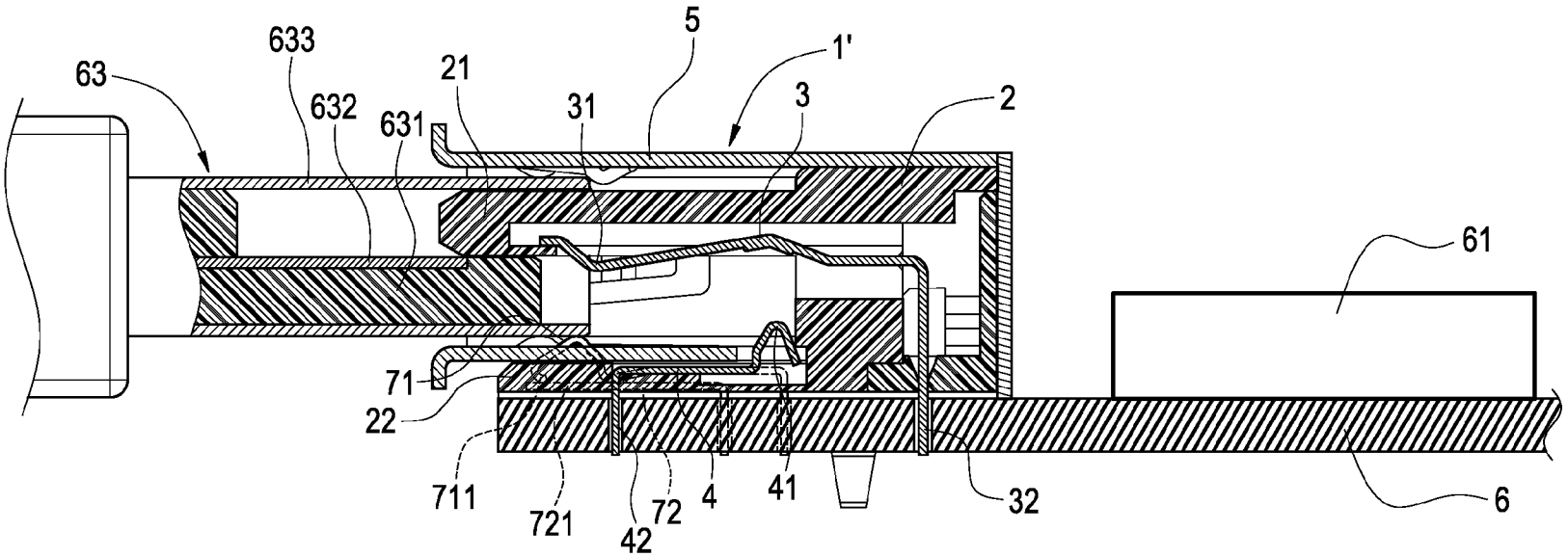
FIG. 6B is a perspective view showing a second insertion action of the third embodiment according to the present invention.
Figure 6C:
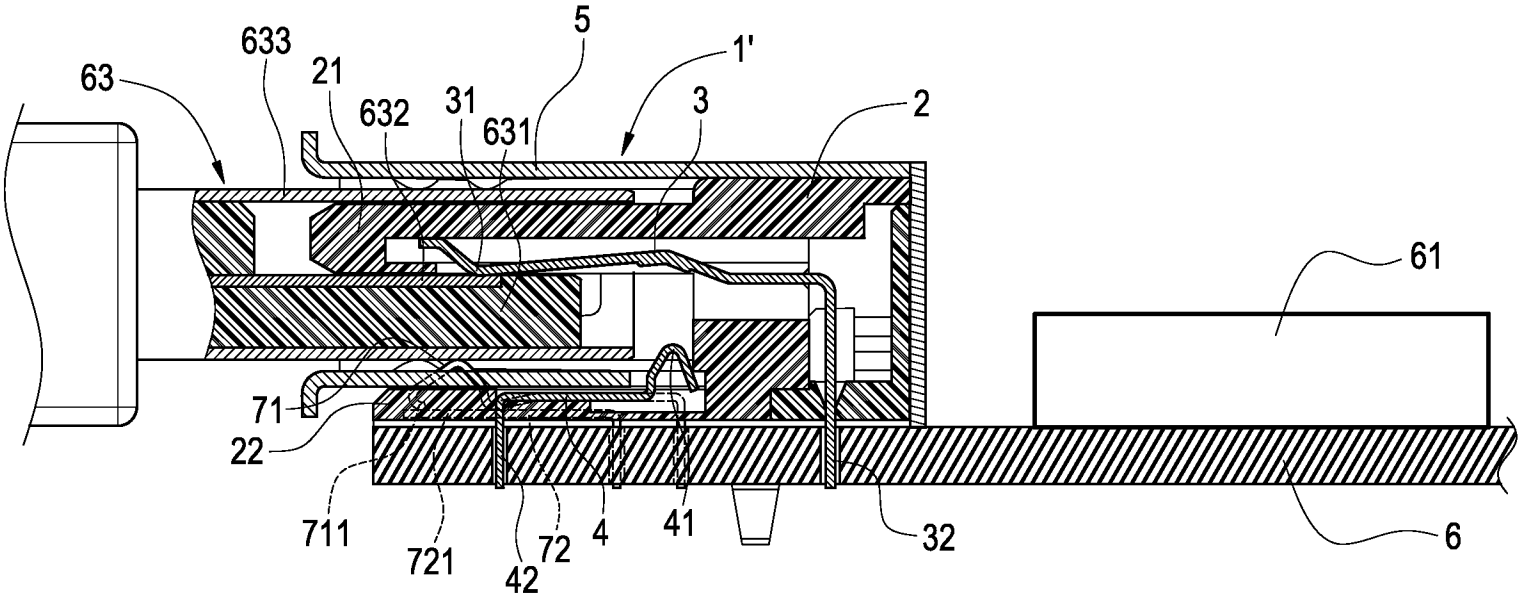
FIG. 6C is a perspective view showing a third insertion action of the third embodiment according to the present invention.
Figure 6D:
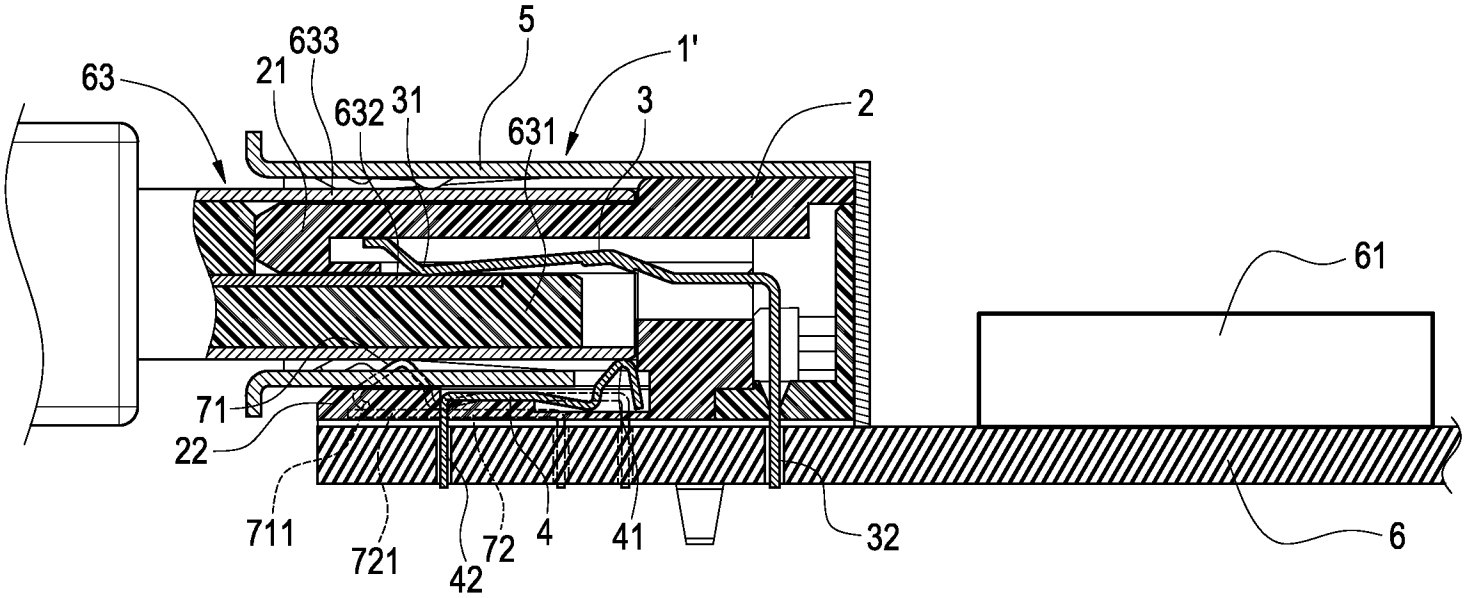
FIG. 6D is a perspective view showing a forth insertion action of the third embodiment according to the present invention.

FIG. 6A is a perspective view showing a first insertion action of a third embodiment according to the present invention. FIG. 6B is a perspective view showing a second insertion action of the third embodiment according to the present invention. FIG. 6C is a perspective view showing a third insertion action of the third embodiment according to the present invention. FIG. 6D is a perspective view showing a forth insertion action of the third embodiment according to the present invention. Another USB connector 1' is disclosed in the third embodiment. The USB connector 1' comprises the body 2, the plurality of conductive terminals 3, the detection terminal 4, the metal housing 5, the tongue portion 21 extended frontward from the top side of the body 2, and the protruding portion 22 extended frontward from the bottom side of the body 2 as described in the USB connector 1. The difference between the USB connector 1' and the above mentioned USB connector 1 is that the USB connector 1' further comprises a first touching terminal 71 and a second touching terminal 72. Furthermore, the protruding portion 22 of the USB connector 1' is longer than that of the USB connector 1, the detection terminal 4 of the USB connector 1' is arranged at the rear edge of the protruding portion 22, and both of the first touching terminal 71 and the second touching terminal 72 are arranged at the leading edge of the protruding portion 22.

As shown in FIG. 6A, the first touching terminal 71 has an abutting end 711 at one end, and the other end of the first touching terminal 71 is away from the abutting end 711 and extended out of the bottom side of the body 2 for being electrically connected with the circuit board 6. The first touching terminal 71 is electrically connected to a plug-unplug detection IC (not shown) arranged on the circuit board 6, and the plug-unplug detection IC can determine whether a male connector is inserted into the USB connector 1' or not through the first touching terminal 71 and the second touching terminal 72. In particularly, the plug-unplug detection IC can be integrated with the power controlling IC 61 into an integrated IC, but not intended to limit the scope of the present invention.

The second touching terminal 72 is exposed from the protruding portion 22 and also has an abutting end 721 at one end, and the other end of the second touching terminal 72 is away from the abutting end 721 and is connected to the metal housing 5 of the USB connector 1' directly. The position of the abutting end 721 of the second touching terminal 72 is according to that of the abutting end 711 of the first touching terminal 71, and the abutting end 721 is above the abutting end 711. As shown in FIG. 6A, with a look straight into the USB connector 1' from the connection portion 10 at the front face of the USB connector 1', the two abutting end 711 and 721 are arranged in front of the conductive portions 31 of the plurality of conductive terminals 3, and the abutting portion 41 of the detection terminal 4 is arranged behind the conductive portions 31 of the plurality of conductive terminals 3.

As shown in FIG. 6B, when the male connector 63 is inserted into the USB connector 1', the shielding housing 633 of the male connector 63 first touches a portion of the second touching terminal 72, which portion is exposed from the protruding portion 22, and the second touching terminal 72 is pressed by the shielding housing 633 to touch the abutting end 711 of the first touching terminal 71 directly by the abutting end 721. Therefore, the plug-unplug IC (or the power controlling IC 61) can conduct to the ground via the first touching terminal 71, the second touching terminal 72 and the metal housing 5, so as to determine that the male connector 63 is already inserted into the USB connector 1' via the conduction. In the other hand, when the two abutting end 711 and 721 are detached from touching to each other, the plug-unplug IC can't conduct to the ground anymore through the two touching terminal 71 and 72, so it can determine that the male connector 63 is unplugged from the USB connector 1'.

As shown in FIG. 6C, when the male connector 63 is inserted further deeper into the connection port 10 of the USB connector 1', each of the plurality of connection terminals 632 of the male connector 63 can electrically connect with a corresponding conductive terminals 3 of the USB connector 1', for transmitting data and power to each other. It should be mentioned that the USB connector 1' is depicted as a USB2.0 type connector in FIG. 6C, so the male connector 63 first connects to a Vcc pin and a GND pin of the plurality of conductive terminals 3 of the USB connector 1', and then connects to a D+ pin and a D− pin of the plurality of conductive terminals 3 of the USB connector 1'.

As shown in FIG. 6D, when being inserted into the USB connector 1' completely, the male connector 63 can touch the abutting portion 41 of the detection terminals 4 directly through the shielding housing 633 thereon. Therefore, the power controlling IC 61 can conduct to the ground through the detection terminal 4, the shielding housing 633 and the metal housing 5, so as to determine the inserted male connector 63 can support high outputted power via the conduction.

Figure 7:
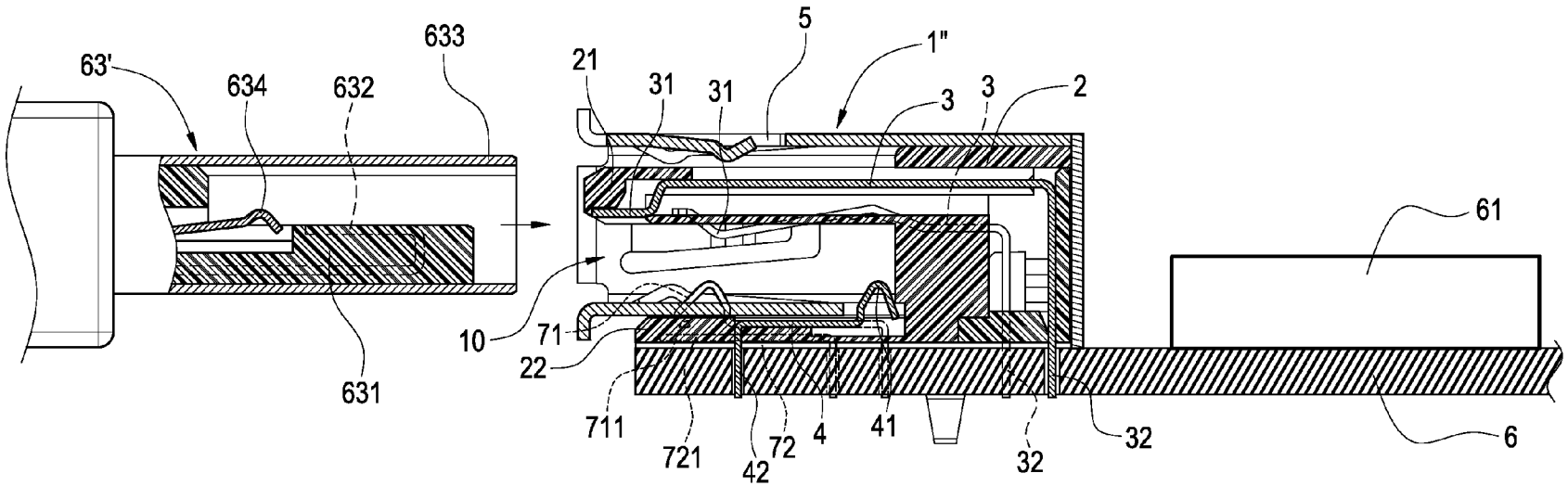
FIG. 7 is a section view of a forth embodiment according to the present invention.

FIG. 7 is a section view of a forth embodiment according to the present invention. The USB connector 1 and 1' are depicted as a USB2.0 type connectors in above drawings, and an amount of the plurality of conductive terminals 3 in the USB connector 1 and 1' is four. In this embodiment, however, an additional USB connector 1", which is depicted as a USB3.0 type connector and has nine conductive terminals 3, is disclosed.

An additional male connector 63' is also disclosed in FIG. 7. The male connector 63' comprises the tongue board 631, the plurality of connection terminals 632 and the shielding housing 633 as the same of the above mentioned male connector 63. However, the male connector 63' further comprises a plurality of second connection terminals 634, which are arranged behind the plurality of connection terminals 632, and exposed from the tongue board 631. A total amount of the plurality of connection terminals 632 and the second connection terminals 634 is nine, so as to consist a USB3.0 type transmission interface. When being inserted into the USB connector 1", the male connector 63' touches: 1. the second touching terminal 72 of the USB connector 1"; 2. the front four conductive terminals 3 of the USB connector 1"; 3. the rear five conductive terminals 3 of the USB connector 1"; and 4. the detection terminal 4, in order. That is to say, the detection function in the present invention can be achieved only if the length of the shielding housing 633 of the male connector 63' matches the depth of the USB connector 1", no matter the male connector 63' and the USB connector 1" are USB2.0 type or USB3.0 type.

Figure 8A:
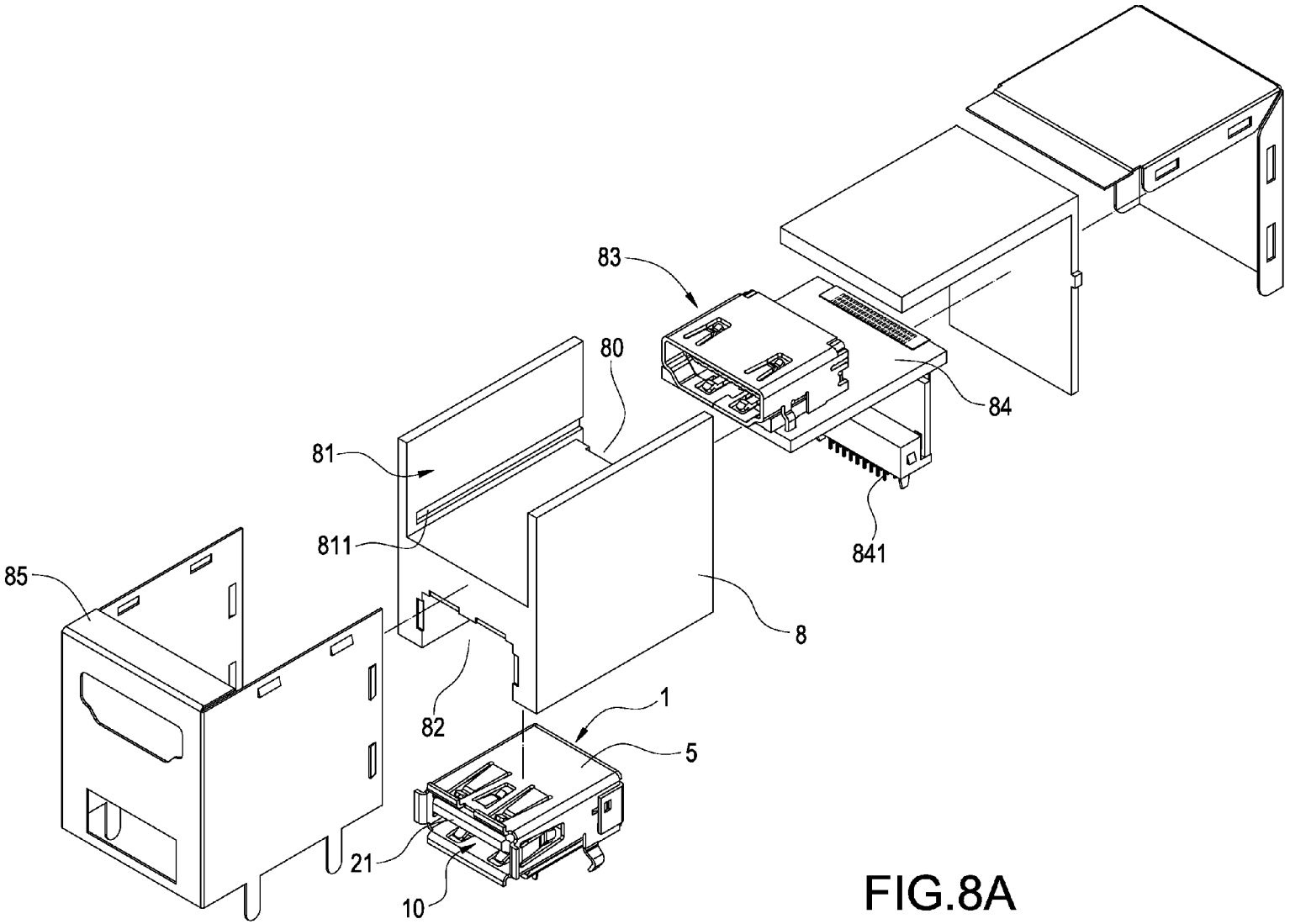
FIG. 8A is an exploded perspective view of a fifth embodiment according to the present invention.
Figure 8B:
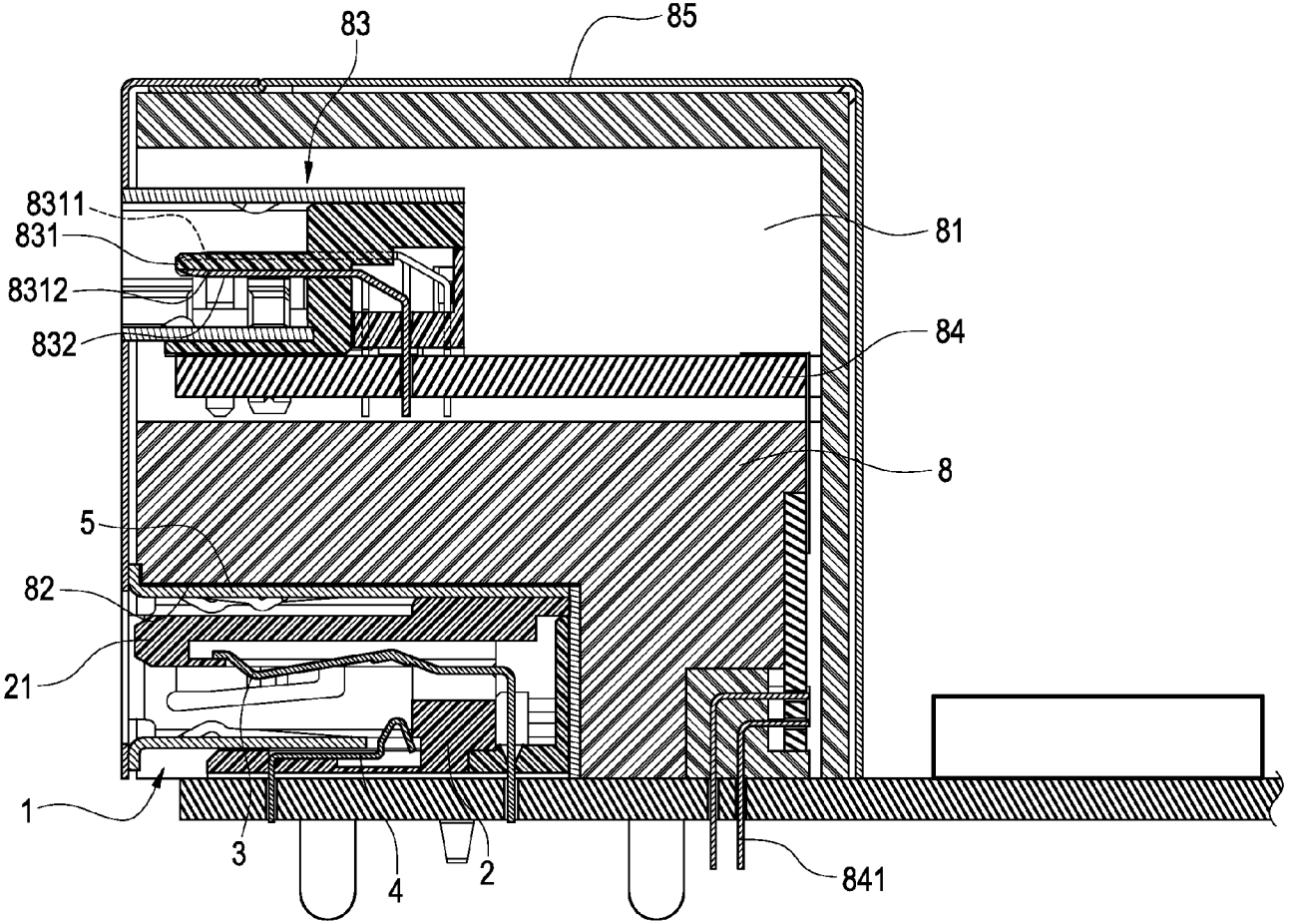
FIG. 8B is a section view of the fifth embodiment according to the present invention.

FIG. 8A is an exploded perspective view of a fifth embodiment according to the present invention. FIG. 8B is a section view of the fifth embodiment according to the present invention. The present invention is related to a stacking connector, and the stacking connector at least comprises the above mentioned USB connector 1, 1' or 1" (referred to the USB connector 1 hereinafter, but not limited). In this embodiment, the stacking connector mainly comprises a main body 8, a first connection module 83, a housing 85 and the USB connector 1.

The main body 8 has a first containing slot 81 and a second containing slot 82 at a top side and a bottom side respectively, and the main body 8 further has a through slot 80 at rear end which is passed through the first containing slot 81 and the second containing slot 82. The first connection module 83 is arranged in the first containing slot 81. As shown in FIG. 8A, the stacking connector further comprises a conductive circuit board 84, the first connection module 83 is electrically connected to the conductive circuit board 84, and arranged in the first containing slot 81 through the conductive circuit board 84. The first containing slot 81 has two corresponding guiding slots 811 at an inner wall, and the conductive circuit board 84 is inserted through the two guiding slots 811 into the first containing slot 81 and fixed the first connection module 83 on the first containing slot 81. A plurality of pins 841 are arranged at one side of the conductive circuit board 84. One end of each of the plurality of pins 841 is connected to the conductive circuit board 84, and electrically connected to the first connection module 3 through the conductive circuit board 84. The other end of each of the plurality of pins 841 is extended out of the bottom side of the main body 8. Therefore, the first connection module 83 can electrically connect to the circuit board 6 through the conductive circuit board 84 and the plurality of pins 841.

The shape and size of the second containing slot 82 matches the shape and size of the USB connector 1, and the second containing slot 82 is used to arrange the USB connector 1. The stacking connector in the present invention is consisted of the main body 8, the first connection module 83 and the USB connector 1. An amount of the first connection module 83 and the USB connector 1 are exampled by one in this embodiment, but not intended to limit the scope of the present invention.

The stacking connector further comprises the shielding housing 85, the shielding housing 85 encapsulates the main body 8, the first connection module 83 and the USB connector 1, for providing shielding effect. In this embodiment, the first connection module 83 can be a high definition multimedia interface (HDMI) connector. The first connection module 83 comprises a tongue portion 831 having a plurality of upper terminal slots 8311 and a plurality of lower terminal slots 8312 respectively at a top side and a bottom side. The first connection module 83 further comprises a plurality of connection terminals 832, each of the plurality of connection terminals 832 is set in a corresponding one of the plurality of upper terminal slots 8311 and the plurality of lower terminal slots 8312, wherein the total amount of the plurality of upper terminal slots 8311 and lower terminal slots 8312 is nineteen, and the amount of the plurality of connection terminals 832 is nineteen, too. Furthermore, the amount of the plurality of pins 841 of the conductive circuit board 84 is nineteen, and the HDMI connector can be electrically connected to the circuit board 6 through the plurality of pins 841.

Figure 9A:
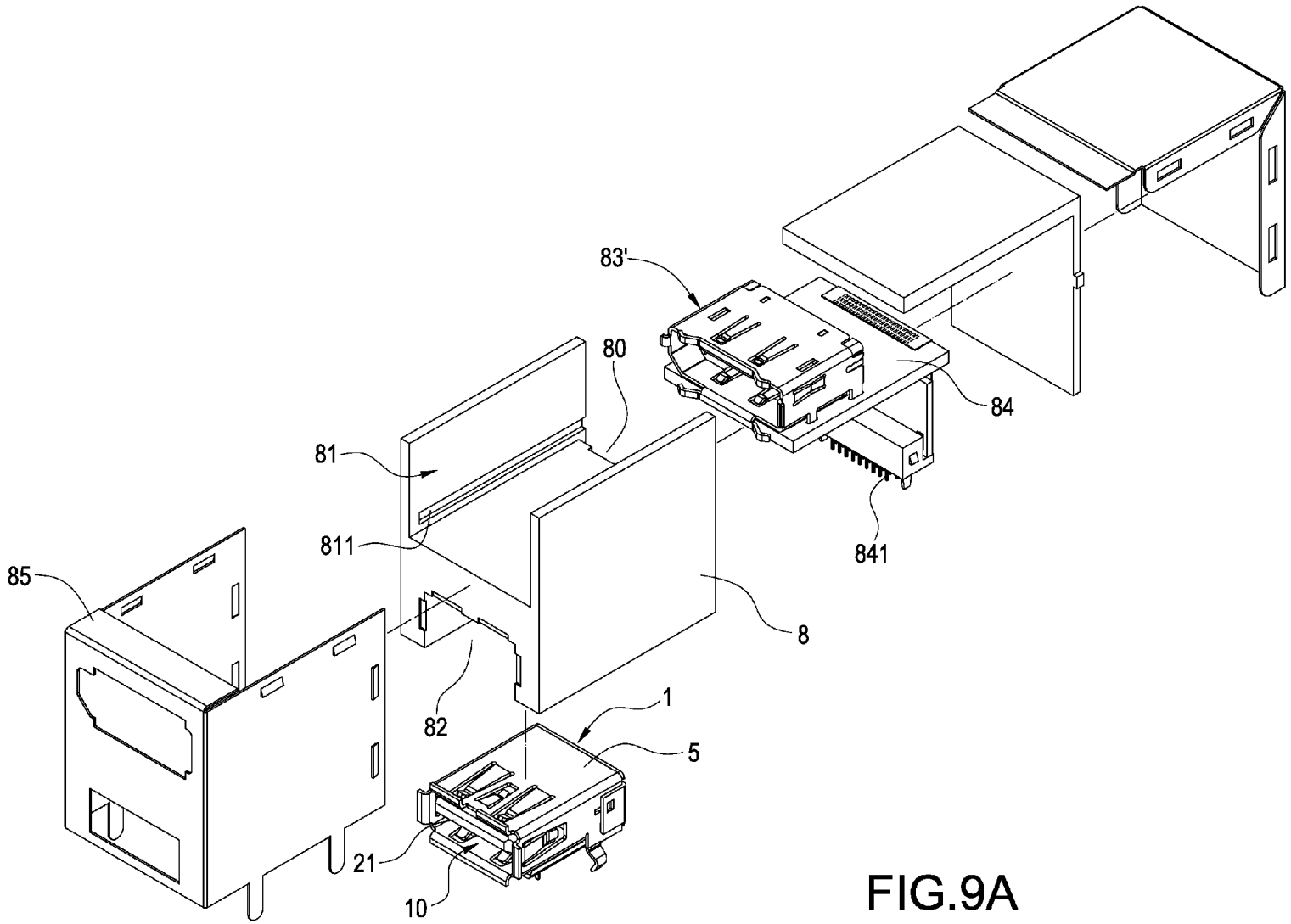
FIG. 9A is an exploded perspective view of a sixth embodiment according to the present invention.
Figure 9B:
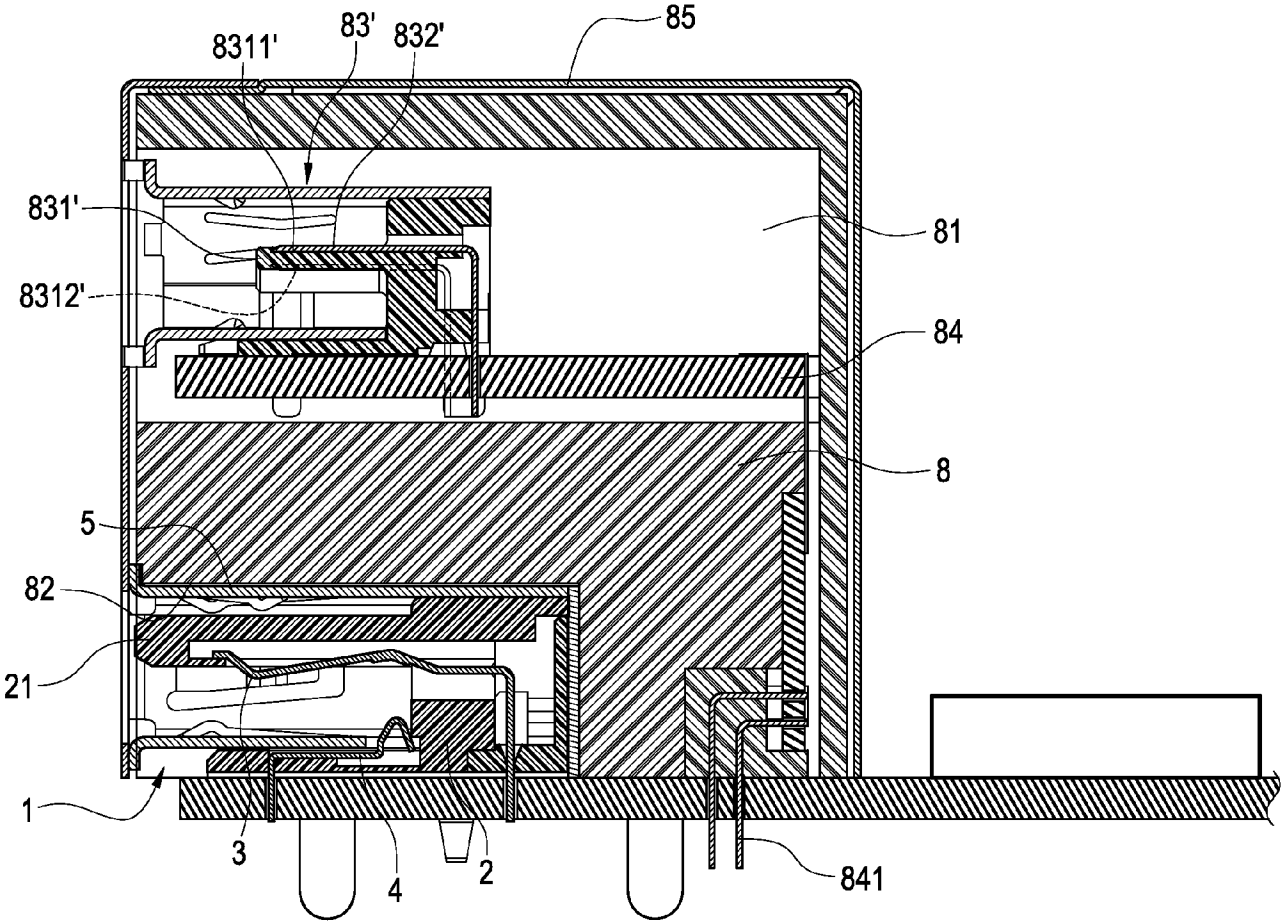
FIG. 9B is a section view of the sixth embodiment according to the present invention.

FIG. 9A is an exploded perspective view of a sixth embodiment according to the present invention. FIG. 9B is a section view of the sixth embodiment according to the present invention. A second type of stacking connector is disclosed in the sixth embodiment, the stacking connector in this embodiment comprises the main body 8 which has the first containing slot 81 and the second containing slot 82 as described above. A second connection module 83' (for example, a DisplayPort connector in this embodiment) is arranged at the first containing slot 81 on the main body 8. The second connection module 83' has a tongue portion 831' having a plurality of upper terminal slots 8311' and a plurality of lower terminal slots 8312' respectively at a top side and a bottom side. The first connection module 83' further comprises a plurality of connection terminals 832', each of the plurality of connection terminals 832' is set in a corresponding one of the plurality of upper terminal slots 8311' and the plurality of lower terminal slots 8312', wherein the total amount of the plurality of upper terminal slots 8311' and lower terminal slots 8312' is twenty, and the amount of the plurality of connection terminals 832' is twenty, too.

Furthermore, the amount of the plurality of pins 841 of the conductive circuit board 84 is twenty in this embodiment, and the second connection module 83' can be arranged on the conductive circuit board 84, therefore, being fixed on the first containing slot 81 of the main body 8 through the conductive circuit board 84, and electrically connected to the circuit board 6 through the plurality of pins 841.

Figure 10:
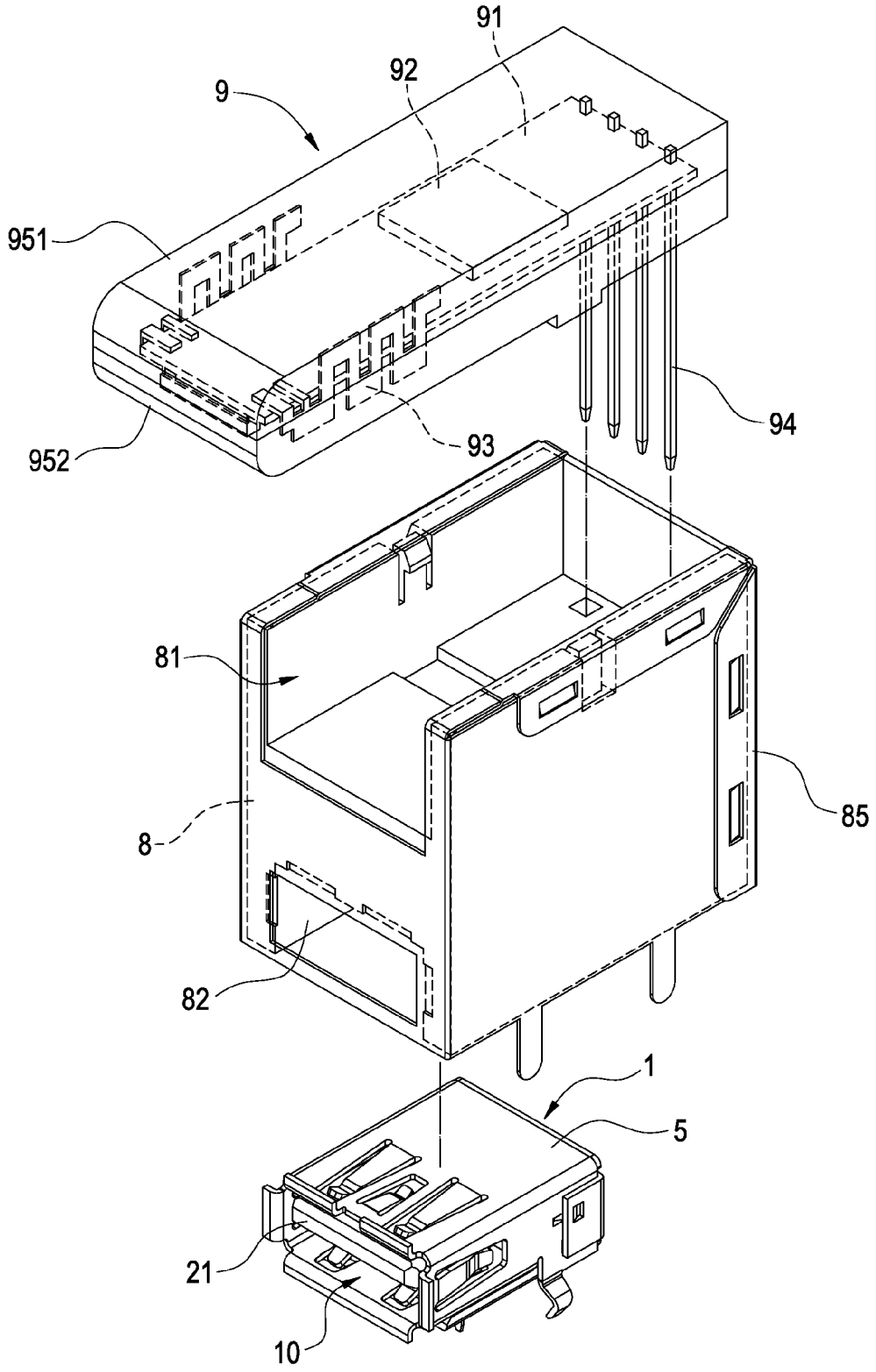
FIG. 10 is an exploded perspective view of a seventh embodiment according to the present invention.

FIG. 10 is an exploded perspective view of a seventh embodiment according to the present invention. A third type of stacking connector is disclosed in the seventh embodiment, the stacking connector in this embodiment comprises the main body 8 which has the first containing slot 81 and the second containing slot 82 as described above. A third connection module 9 is arranged on the first containing slot 81 of the main body 8. The third connection module 9 in this embodiment is, for example, a wireless transmission module which can provide Wi-Fi, Bluetooth, near field communication (NFC), Zigbee, 3$^{rd}$ generation (3G), 3.5G or long-term evolution (LTE/4G) communication function.

The third connection module 9 mainly comprises a circuit board 91, a wireless controlling IC 92, an antenna 93, a plurality of pins 94, a top cover 951 and a bottom cover 952, wherein the wireless controlling IC 92, the antenna 93 and the plurality of pins 94 are electrically connected to the circuit board 91 respectively. In this embodiment, the antenna 93 is a planar inverted F-shaped antenna (PIFA) for example. The antenna 93 is arranged on an edge of one side of the circuit board 91, and the antenna 93 is extended out of the main body 8 for reaching better communication quality when the third connection module 9 is contained in the first containing slot 81 of the main body 8.

The antenna 93 is electrically connected to the wireless controlling IC 92 through the circuit board 91, and the wireless controlling IC 92 is a type of controlling IC which is capable of Wi-Fi, Bluetooth, NFC, Zigbee, 3G, 3.5G or LTE/4G communication protocol.

The wireless controlling IC 92 is electrically connected to the plurality of pins 94 through the circuit board 91. One end of each of the plurality of pins 94 is electrically connected to the circuit board 91, and the other end of each of the plurality of pins 94 is extended out of the bottom side of the main body 8, for connecting to the circuit board 9. Therefore, the electronic device (not shown) arranges the circuit board 6 can execute wireless communication through the third connection module 9. The top cover 951 and the bottom cover 952 encapsulate the wireless controlling IC 92, the antenna 93 and the circuit board 91, however, the plurality of pins 94 are exposed from the top cover 951 and the bottom cover 952.

Figure 11:
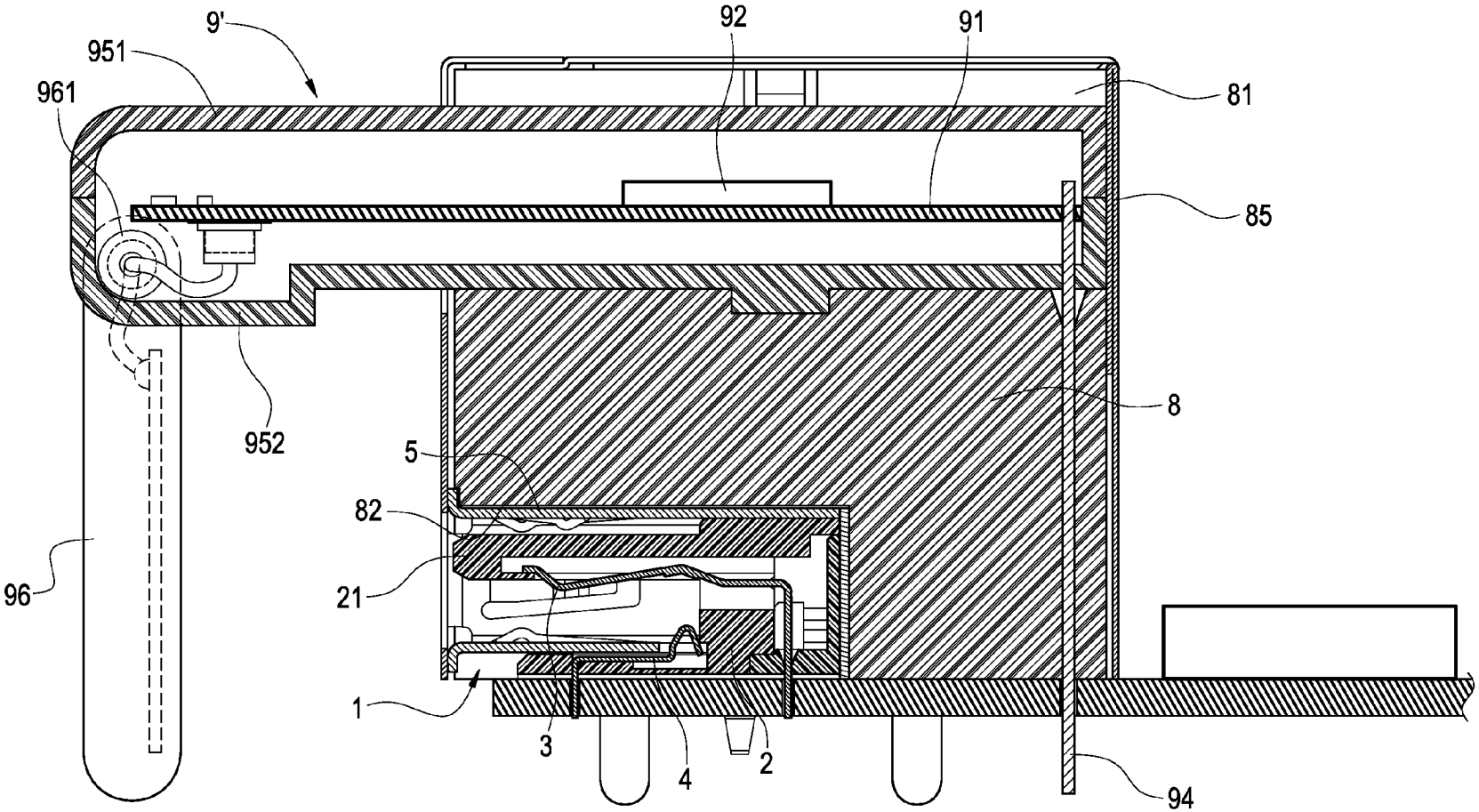
FIG. 11 is a combination perspective view of an eighth embodiment according to the present invention.

FIG. 11 is a combination perspective view of an eighth embodiment according to the present invention. A forth type of stacking connector is disclosed in the eighth embodiment, the stacking connector in this embodiment comprises the main body 8 which has the first containing slot 81 and the second containing slot 82 as described above. A forth connection module 9' (for instance in this embodiment, a wireless module) is arranged on the first containing slot 81 of the main body 8. The difference between the forth connection module 9' and the above mentioned third connection module 9 is that the antenna 93 of the third connection module 9 is replaced with a second antenna 96 of the forth connection module 9'. As shown in FIG. 11, the second antenna 96 is an adjustable antenna for instance. The second antenna 96 is arranged external on the top cover 951 and the bottom cover 952, and is electrically connected to the circuit board 91 through electric circuit (not shown), and is electrically connected to the wireless controlling IC 92 through the circuit board 91. Furthermore, the second antenna 96 is jointed with one side of the top cover 951 and/or the bottom cover 952 through a pivot hinge 961, and user can adjust the position of the second antenna for reaching better communication quality.

Although the present invention has been described with reference to the foregoing preferred embodiments, it will be understood that the invention is not limited to the description thereof. Any equivalent variations and modifications can be made to those skilled in the art in view of the teaching of the present invention are also in the scope of the invention as defined in the appended claims.

What is claimed is:

1. A stacking connector electrically connected to a circuit board having a power controlling integrated circuit (IC), the stacking connector comprising:

a main body having a first containing slot and a second containing slot;

a connection module being arranged on the first containing slot;

a USB connector having a detection function, the USB connector being arranged on the second containing slot and having a body, a plurality of conductive terminals, at least one detection terminal and a metal housing, a tongue portion extended frontward from a top side of the body and having a plurality of upper terminal slots, a protruding portion extended frontward from a bottom side of the body and having at least one lower terminal slot, each of the plurality of conductive terminals being set in a corresponding upper terminal slot of the tongue portion, the detection terminal being set in the lower terminal slot, and the metal housing encapsulating the body, the plurality of conductive terminal and the detection terminal; and a shielding housing encapsulating the main body, the connection module and the USB connector for providing shielding effect, wherein each of the plurality of conductive terminals has a conductive portion at one end and a welding portion at the other end, each of the conductive portions is exposed out of the tongue portion, each of the welding portions is bended downward and extended out of a bottom side of the body, wherein the detection terminal has a abutting portion at one end and a welding portion at the other end, the abutting portion of the detection terminal is exposed out of the protruding portion and arranged behind the conductive portions of the plurality of conductive terminals, and the welding portion of the detective terminal is extended out of the bottom side of the body for electrically connecting to the circuit board, and electrically connecting to the power controlling IC through the circuit board.

2. The stacking connector according to claim 1, wherein a distance between the abutting portion of the detection terminal and a leading edge of the tongue portion is longer than 8.7 mm.

3. The stacking connector according to claim 2, wherein the distance between the abutting portion of the detection terminal and the leading edge of the tongue portion is between 8.8 mm and 10.2 mm.

4. The stacking connector according to claim 2, wherein the detection terminal is arranged on a rear edge of the protruding portion, the USB connector further comprises a first touching terminal and a second touching terminal arranged on a leading edge of the protruding portion, both of the first touching terminal and the second touching terminal have a abutting end at one end, and the second touching terminal is exposed out of the protruding portion, wherein the other end of the first touching terminal is extended out of the bottom side of the body and electrically connected to the circuit board, and the other end of the second touching terminal is connected to the metal housing of the USB connector, and the abutting end of the first touching terminal and the abutting end of the second touching terminal touches to each other while the second touching terminal is pressed through an external force.

5. The stacking connector according to claim 2, wherein an amount of the plurality of conductive terminals is four or nine, and the USB connector is a USB2.0 type connector or a USB3.0 type connector.

6. The stacking connector according to claim 2, wherein the first containing slot has two corresponding guiding slots at an inner wall, and the main body has a through slot passed through the first containing slot and the second containing slot at a rear side, and the stacking connector further comprises a conductive circuit board electrically connecting to the connection module, the conductive circuit board is inserted through the two guiding slots into the first containing slot and fixes the connection module on the first containing slot, a plurality of pins are arranged at one side of the conductive circuit board, one end of each of the plurality of pins is connected to the connection module through the conductive circuit board, and the other end of each of the plurality of pins is extended out of the bottom side of the main body.

7. The stacking connector according to claim 6, wherein the connection module is a HDMI connector.

8. The stacking connection according to claim 6, wherein the connection module is a DisplayPort connector.

9. The stacking connector according to claim 2, wherein the connection module is a wireless transmission module comprising a circuit board, a wireless controlling IC, an antenna, a plurality of pins, a top cover and a bottom cover, wherein the wireless controlling IC, the antenna and the plurality of pins are electrically connected to the circuit board, the top cover and the bottom cover encapsulates the wireless controlling IC, the antenna, the circuit board and the plurality of pins, and one end of each of the plurality of pins is electrically connected to the circuit board, and the other end of each of the plurality of pins is extended out of the bottom cover.

* * * * *